US010975638B2

(12) United States Patent
Roodenburg et al.

(10) Patent No.: US 10,975,638 B2
(45) Date of Patent: Apr. 13, 2021

(54) DRILLING RIG COMPRISING TUBULAR STAND HANDLING SYSTEM

(71) Applicant: ITREC B.V., Schiedam (NL)

(72) Inventors: Joop Roodenburg, Schiedam (NL); Pieter Dirk Melis Van Duivendijk, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 16/608,787

(22) PCT Filed: Apr. 26, 2018

(86) PCT No.: PCT/NL2018/050270
§ 371 (c)(1),
(2) Date: Oct. 25, 2019

(87) PCT Pub. No.: WO2018/199754
PCT Pub. Date: Nov. 1, 2018

(65) Prior Publication Data

US 2020/0199951 A1 Jun. 25, 2020

(30) Foreign Application Priority Data

Apr. 28, 2017 (NL) ..... 2018811

(51) Int. Cl.
*E21B 19/16* (2006.01)
*E21B 19/07* (2006.01)
(Continued)

(52) U.S. Cl.
CPC ..... *E21B 19/165* (2013.01); *E21B 19/07* (2013.01); *E21B 19/10* (2013.01); *E21B 19/146* (2013.01); *E21B 19/20* (2013.01); *E21B 19/161* (2013.01)

(58) Field of Classification Search
CPC ..... E21B 19/165; E21B 19/07; E21B 19/10; E21B 19/146; E21B 19/20; E21B 19/161
See application file for complete search history.

(56) References Cited

U.S. PATENT DOCUMENTS 3,718,316 A * 2/1973 Larralde ..... B66C 13/02 254/277
2014/0283653 A1 9/2014 Richardson
2015/0027732 A1* 1/2015 Wood ..... E21B 19/07 166/380

FOREIGN PATENT DOCUMENTS

GB 2 334 270 A 8/1999
WO WO 2015/133895 A1 9/2015

OTHER PUBLICATIONS

International Search Report for PCT/NL2018/050270 (PCT/ISA/210) dated Jul. 10, 2018.
(Continued)

*Primary Examiner* — David J Bagnell
*Assistant Examiner* — Dany E Akakpo
(74) *Attorney, Agent, or Firm* — Birch, Stewart, Kolasch & Birch, LLP

(57) ABSTRACT

The invention relates to a drilling rig comprising: a tubular stand support tower, tubular stand storage rack, slip device for supporting multiple tubular stands, and a tubular stand connecting device. According to the invention the rig is provided with a tubular stand handling system, adapted to move a tubular stand between the storage rack and a position in the firing line above the tubular string slip device, and adapted to rotatable support the tubular stand in the firing line during spinning in, to allow for connecting the tubular stand with the tubular string, and during spinning out, to allow for disconnecting the tubular stand from the tubular string, the tubular stand handling system comprising. The tubular stand handling system comprises vertical rails and a
(Continued)

lower motion arm assembly and an upper motion arm assembly comprising grippers, mounted on said vertical rails. Also provided is a weight compensation control system.

19 Claims, 8 Drawing Sheets

(51) Int. Cl.

| | |
|---|---|
| ***E21B 19/10*** | (2006.01) |
| ***E21B 19/14*** | (2006.01) |
| ***E21B 19/20*** | (2006.01) |

(56) References Cited

OTHER PUBLICATIONS

Written Opinion of the International Searching Authority for PCT/NL2018/050270 (PCT/ISA/237) dated Jul. 10. 2018.

* cited by examiner

DRILLING RIG COMPRISING TUBULAR STAND HANDLING SYSTEM

FIELD AND BACKGROUND OF THE INVENTION

The present invention relates to drilling rig comprising tubular stand handling system. More particularly the invention relates to an apparatus and a method for connecting tubular stands to compose a tubular string for use in a wellbore. More particularly the invention relates to an apparatus and method for supporting and compensating a tubular stand during connection.

In the construction and completion of oil and gas wells, a drilling rig is used to enable insertion and removal of a tubular string into a wellbore.

The tubular strings are constructed by combining tubular stands, which are sets of combined threaded tubulars, e.g. drilling tubulars, casing. The tubulars typically have a tubular section with a pin end and a box end, the pin end being provided with outside wire, the box end with inside wire. The tubulars, and thus the tubular stands, are connected, or made-up, by screwing the pin end of one tubular into the box end of another tubular. Alternatively, already made-up tubulars may be unthreaded, also known as break-out, to disassemble a tubular string.

Typically, the tubular stand to be connected is supported at its top end by a top drive in the firing line of a drilling tower. The tubular stand is than lowered until the lower end of the tubular stand is landed on the top end of a tubular stand supported in a slip device. The pin end is inserted in the box end while the tubular stand is rotated to make-up the connection. The tubular stand may be turned by using the top drive and may be lowered using the drawworks, or by using a power tong or pipe spinners in conjunction with the pipe handling system.

Prior art publication WO2015/133895 relates to a racking device. The publication discloses a vessel with a drilling tower mounted on the hull above a moonpool. The drilling tower is associated with drawworks, the drawworks forming a firing line along and on the outside of the drilling tower. The firing line is designed for performing drilling, and includes a top drive adapted for rotary driving a drill string, and a slip device adapted to support the weight of a tubulars string, suspended therefrom along a firing line. The vessel is also equipped with two drilling tubulars rotary storage racks, adapted to store multiple drilling tubulars in vertical orientation, preferably multi-jointed tubular stands.

The drilling tower supports a racking device that is adapted to move a tubular between a storage rack and a position in the firing line above the tubulars string slip device. The racking device is furthermore adapted to bring a tubular retrieved from the storage rack into a vertical motion towards the tubulars string supported by the slip device, thereby allowing for the connection of the tubular to the suspended tubulars string.

The disclosure provides a racking device that has three motion arm assemblies, which motion arm assemblies are arranged on a common vertical rails that is fixed to the drilling tower. The three motion arm assemblies comprise a well center tool motion arm assembly, a lower racker motion arm assembly and an upper motion arm assembly. The two racker motion arm assemblies are arranged, one above the other, on the vertical rails above the tool motion arm assembly.

The publication further discloses the handling of a drill pipe multi-joint tubular by means of racker assemblies, wherein each of the racker motion arm assemblies carries a tubular gripper member, to support a drill pipe multi-joint tubular in the firing line above the well center, while the well center tool motion arm assembly carries an iron roughneck device, with a spinner thereon as well, to connect the tubular to a drill string supported by a drill string slip device.

It is critical not to damage the threads when the pin end is stabbed into the box end, or when torque is applied to overcome the weight of the second tubular resting on the threads.

In the prior art, it is common to let the pipe stand rest with all its weight against the corresponding threads in the pipe string during the entire make-up operation. During the screwing operation, it is further common to control the relative rate of displacement between the machines holding the pipe and the pipe string, at a rate corresponding to the rotational speed multiplied by the pitch of the threads.

The problem is increased with mechanized handling of the pipes, in which the pipe to be assembled is positioned against the pipe string In a relatively rigid way compared with earlier practice. A large axial force, and thereby large friction, on the threads further entails the need for a greater torque in order to assemble or disassemble the threaded pipes.

In order to facilitate tubular connection compensators have been used to prevent damage to the threads. During makeup of the connections compensators support the weight of the tubular being lowered to minimize the axial load transferred from the pin end to the box end during makeup.

For example, prior art publication US2014/0283653 discloses a power tong that includes a fixed back-up jaw and a rotor. The backup jaw section is adapted to hold the threaded tapered male end, or pin, of a tubular. The rotor section is adapted to hold the threaded tapered female end, or box, of a tubular. The rotor is rotated to rotate the pin end relative to the box end held in the fixed back-up jaw section to make up or break out threaded joints between tubulars.

The disclosed power tong is provided with thread compensator pistons, to selectively adjust the vertical spacing between the rotor section and the backup jaw section. Thus, the rotor and back-up jaw may be drawn towards one another by the retraction of rods into thread compensator pistons, or alternately, separated from one another by the extension of rods from cylinders. This action serves to compensate for the axial thread advance of the tubular as it is screwed in or out and avoids excessive axial forces on the tubular threads.

The combined upward force exerted by the thread compensators is controlled via hydraulic pressure to approximately equal the weight of the upper tubular. Tubular thread wear is thus reduced, because the threads are "unweighted" when spinning in or out.

Thus, with the prior art power tong, the rotor section supports the weight of the tubular as it is screwed in or out.

The invention has for its object to remedy or reduce at least one of the drawbacks of the prior art.

A further object of the invention is to provide an improved tubular stand handling system for facilitating connecting or disconnecting a tubular stand to or from a tubular string.

SUMMARY OF THE INVENTION

According to the present invention, the object is achieved in accordance with the invention through the features which are specified in the description below and in the claims that follow, in particular by providing a drilling rig according to claim 1.

A drilling rig according to the invention comprises:

a tubular stand support tower, e.g. drilling tower or multipurpose tower, the tubular stand support tower defining a firing line;

a tubulars stand storage rack, e.g. a carousel, adapted for storage of tubular stands, e.g. sets of combined drilling tubulars, in vertical orientation therein, a tubulars string slip device, which slip device is adapted to support the weight of a tubulars string, e.g. a string comprising multiple tubular stands, suspended therefrom in the firing line, a tubular stand connecting device, e.g. a power tong and/or pipe spinner, adapted to connect a lower pin end of the tubulars stand to an upper box end of the tubulars string supported in the firing line by the slip device, to extend the tubular string during tripping in, and/or to disconnect the lower pin end of the tubular stand from the upper box end of the tubular string, to shorten the tubular string during tripping out;

a tubular stand handling system, adapted to move a tubular stand between the storage rack and a position in the firing line above the tubular string slip device, and adapted to rotatable support the tubular stand in the firing line during spinning in, to allow for connecting the tubular stand with the tubular string, and during spinning out, to allow for disconnecting the tubular stand from the tubular string, the tubular stand handling system comprising:

a vertical rails, mounted to the tubular stand support tower along at least part of the firing line;

a lower motion arm assembly and an upper motion arm assembly, mounted on said vertical rails for respectively engaging a tubular stand at a lower region and an upper region thereof, wherein each motion arm assembly comprises:

a mobile base, which mobile base is supported by the vertical rails, and is vertically mobile along said vertical rails by a vertical drive including a motor, which vertical drive is positioned on said mobile base;

a motion arm, which motion arm is connected to said mobile base, the motion arm preferably being pivotably connected to the mobile base for pivoting about a vertical axis; and a tubular gripper member, which gripper member is connected to the motion arm, and which gripper member comprises:

grippers for engaging a tubular section of a tubular stand, which grippers are movably supported for movement relative to the mobile base in a compensation direction directed substantially parallel to the firing line, and which grippers are provided with rollers to enable the gripper to support a tubular section of a tubular stand along a longitudinal axis of that tubular stand while allowing rotation of that tubular section about that longitudinal axis; and one or more compensator pistons, for moving the grippers relative to the mobile base in the compensation direction, wherein the one or more compensator pistons are configured to support the weight of the grippers and at least part of the weight of the tubular stand engaged by the grippers, a weight compensation control system, which control system controls the compensator pistons of the lower motion arm assembly and the upper motion arm assembly, and which control system is adapted to increase the pressure in the compensator pistons when the tubular stand is landed on the tubular string, by moving the motion arm assembly and/or the grippers supporting the tubular stand downward, to prevent the full weight of the tubular stand from being transferred onto the tubular string.

The tubular stand handling system comprises multiple motion arm assemblies for manipulating a tubular stand. The motion arm assemblies comprise grippers adapted to support the weight of a tubular stand while allowing the tubular stand to be rotated about its longitudinal axis, compensator pistons that can push the grippers upwards relative to mobile base of the motion arm assemblies, and a weight compensation control system that controls the weight compensator pistons of the motion arm assemblies.

Thus, the weight compensation control system allows for the tubular stand to be manipulated by the motion arm assemblies, but also for the tubular stand handling system to support the tubular stand during spinning in and spinning out. Thus the tubular stand handling system support the tubular stand at a lower region and at an upper region and preventing the full weight of the tubular stand to bear down on tubular string supported in the slip device during landing of the tubular stand on the top of the tubular string and during spinning in and spinning out.

The present invention thus provides a drilling rig comprising a tubular stand handling system for facilitating connecting or disconnecting a tubular stand to or from a tubular string.

The weight compensation control system according to the invention is adapted to control the amount of weight that is transferred onto the tubular string, when the tubular stand rests on the tubular string, without moving the mobile section of the motion arm assemblies. Typically, the motion control assemblies, which are designed to move the tubular stands into and out of the firing line, are large and heavy compared to the grippers. By using only the grippers instead of the motion arm assemblies to control the amount of weight of the tubular stand that is transferred on the tubular string, less mass needs to be moved, which allows for relatively quick and efficient action.

In an embodiment, the weight compensation control system is furthermore adapted to control the distribution of the tubular stand weight over the motion arm assemblies, in particular during lifting and lowering of the tubular stand and during moving the tubular stand into and out of the firing line. Thus, by adapting the pressure in the compensator pistons, the weight compensation control system can be used to ensure that the weight of the tubular stand is evenly distributed over the motion arm assemblies. Also, the weight compensation control system can thus compensate for sub optimal synchronous movement of the, independently movable, motion arm assemblies. For example, when during the lifting or lowering of a tubular stand the motion arms assemblies move closer towards each other, or move further way from each other, the weight compensation control system can compensate by adjusting the pressure of the compensator pistons to thus ensure the weight remains evenly distributed between the motion arm assemblies, and may even prevent buckling or stretching of the tubular stand and/or unwanted stresses on the connections between the tubular of the tubular stand.

In an embodiment according to the invention, the tubular stand handling system is adapted to support a tubular stand in a lower region and in an upper region thereof. This is in particular beneficial when manipulating long, and thus comparatively flexible, tubular stands.

The invention furthermore allows for providing additional motion arm assemblies, also controlled by the weight compensation control system, to provide additional support and/or allow for handling extra-long pipe stand. For example, the tubular stand handling system may comprise a third, intermediate motion arm assembly, located above the lower motion arm assembly and below the upper motion arm assembly on the vertical rail, to support the tubular stand at a mid-section.

In an embodiment according to the invention, the tubular stand handling system is adapted to support a tubular stand in a lower region and in an upper region thereof. It is submitted that because the motion arm assemblies can move independently from each other, the invention also allows for supporting a tubular stand at other regions, e.g. at a top region and a mid-region of the tubular stand, if the circumstance would require this. For example, when the power tong or torque wrench is provided that is adapted to support the lower region of the tubular stand, the lower motion arm assembly may engage the tubular stand at a mid-section instead of at a lower section of the tubular stand.

In an embodiment, the weight compensation control system is adapted lower and lift the tubular stand during spinning in and spinning out procedures by adjusting the pressure in the compensator pistons, and to monitor the vertical position of the tubular stand and/or the weight transferred on the threads by monitoring the pressure in the compensator pistons. Thus, the control system can maintain a substantially constant weight load on the threads. In a further embodiment, the weight compensation control system is linked with the power tong, spinner and/or torque wrench used for making the connection, and adjusts the percentage of the stand weight transferred onto the tubular string during the spinning process. For example, when the torque wrench attains maximum torque at the end of the spinning process, the weight may be increased. On the other end, if at the beginning of the spinning process the torque required for rotating the tubular stand is relatively high, the amount of transferred stand weight may be reduced in order to lower friction, and thus reduce the required torque, which may prevent damage to the threads.

According to the invention the two or more motion arm assemblies are provided with weight compensator control pistons, which are linked to a central weight compensation control system. The weight compensation control system is adapted to provide the compensator pistons with a predefined load pressure, which compensates a part of the weight of the stand supported by the grippers. For example, weight compensation control system can be adapted to provide a predefined load pressure that enables the compensator pistons to, in combination, support 90% of the stand weight. Thus, in this configuration, the tubular stand supported by the motion arm assemblies rest with 10% of its stand weight on the top end of the tubular string, and rests with 90% of its stand weight on the motion arm assemblies.

The weight compensation control system preferably allows for compensating the full weight of the tubular stand, such that a weight compensation range of 0% up to 100% of the stand weight is available. Preferably, the weight compensation system is able to provide a weight compensation range that extends above the stand weight, e.g. up to 110% of the stand weight. In an alternative embodiment, the weight compensation system is adapted to deliver up to 90% of the stand weight. In such a configuration, the tubular stand will not be lifted, relative to the motion arm, by the compensator pistons. Only after the tubular stand has been landed on the tubular string, and the grippers may move upwards relative to the motion base of the motion arm assembly moving downwards along the vertical rails.

In this context it is submitted that a tubular stand handling system typically is configured to handle tubular stands of different sizes and weights.

The weight compensation control system may be provided with predefined stand weight support pressure, for example of 70%, 80%, 90% and 95% of the tubular stand weight of a typical stand, to be maintained during the landing of the tubular stand and/or the connecting or disconnecting of the tubular stand to or from the tubular string.

The weight compensation control system may be provided with predefined stand weight spinning in pressure and a stand weight spinning out pressure, to be maintained during the connecting or disconnecting of the tubular stand to or from the tubular string. For example, during spinning in or spinning out, the position of the tubular stand relative to the tubular string changes. The weight compensation control system is adapted to control the pressure in the pistons to compensate for this change in position, and thus keep the weight transferred substantially constant during the spinning process.

It is submitted that the stand weight of tubular stands is often known, since the weight of the tubulars comprises in the tubular stand is known. Also, the stand weight can be registered when the stand is assembled, e.g. on a tubular stand assembly site adjacent the drilling rig. In an embodiment, the tubular stand manipulation system is adapted to register the weight of the tubular stand, e.g. to weigh the tubular stand when it is lifted from the stand rack. In an embodiment, the compensator pistons are used to define the weight of the stand. In such an embodiment, the pressure in the pistons is increased after the grippers have engaged the tubular stand in the rack, and the pressure is registered at which the tubular stand is lifted from the rack. This pressure can be used as a reference pressure during the handling of the tubular stand and/or can be used to link the tubular stand to a stand weight. As an alternative, or in addition, load sensors can be used to determine the weight of the stand supported by the grippers. Alternative solutions for determining the weight of the stand supported by the grippers can also be used within the scope of the invention. It is submitted that provided with the insights herein, the skilled person is able to design such alternative solutions.

In an embodiment, the control system is adapted to control the pressure in the compensator pistons, such that by an increase of that pressure the grippers is moved upward relative to the mobile base of the motion arm, to enable only part of the weight of the tubular stand to be transferred onto the tubular string In an embodiment, the weight compensation control system is provided with sensors providing operational information of the compensator pistons, e.g. pressure information and/or position information or load information. In a further embodiment, the weight compensation control system comprises a hydraulic power system for actuating the compensator pistons. In an embodiment, each of the motion arm assemblies is provided with a hydraulic power system, which are linked to the weight compensation control system, which preferably are located on the mobile base or motion arm. By providing the hydraulic control system on the motion arm assemblies, in contrast with providing it on the tubular stand support tower, hydraulic power lines can be kept short. Linking them to the weight compensation control system allows for the motion arm assemblies to operate in unison. i.e. to enable synchronous movement of the grippers and control of even load sharing over the assemblies.

In an embodiment, the weight compensation control system controls the gripping members, i.e. actuation of the grippers, and preferably controls the movement of the motion arm assemblies. In an embodiment, the weight compensation control system is part of a tubular stand handling system control system, which tubular stand handling system control system controls the motion arm assemblies and for example is linked to a power tongue and/or torque wrench.

It is submitted that the weight compensation control system and a tubular stand handling system control system may also comprise a user interface to enable manual control, or computer assisted manual control of the systems and equipment linked to it.

In an embodiment, the grippers are supported by the compensator pistons, and the compensator pistons are configured to move the grippers along a weight support trajectory that extends parallel to the firing line and to a line of action of the piston, i.e. the central axis of the piston. In such an embodiment, the stand weight supported by the gripper is transferred to the motion arm via the compensator piston.

In an alternative embodiment, the grippers are linked to the motion arm by way of a linkage system, which linkage system is configured to transfer at least part of the tubular stand weight supported by the gripper to the motion arm.

In an embodiment, the grippers of a motion arm can be moved, by actuating the compensator pistons along a weight support trajectory, which weight support trajectory preferably extends parallel to the firing line, preferably in a vertical direction. In a further embodiment, the gripper member has a grippers support, which grippers support is adapted to support the gripper when at the lower end of the weight support trajectory. Thus, when the compensator pistons are not actuated, or are actuated to the extend that they support only part of the weight that is supported by the gripper, the gripper is supported by the grippers support. When the actuated compensator pistons provide a weight compensation force that surpasses the weight of the gripper and the weight supported by that gripper, the gripper is lifted from the gripper support.

In an embodiment, the weight compensation control system is adapted to allow the tubular stand to land on the tubular string by moving the motion arm assemblies in a downward direction along the vertical rails, and is adapted to actuate the compensator pistons when the tubular stand contacts the tubular string such that not all of the weight of the tubular stand is transferred onto the tubular string, and to keep the stand weight transferred onto the tubular string substantially constant while the tubular stand contacts the tubular string and the motion arms moves further downwards.

In an alternative embodiment, the actuator pistons are actuated prior to the tubular stand being landed on the tubular string, e.g. at a stand weight support pressure to compensate 90% of the tubular stand weight, and the weight compensation control system is adapted to keep that load pressure, and thus the weight compensation constant while the tubular stand is landed and the motion arm assembly moves further downward and/or during connecting of the tubular stand to the tubular string.

In an embodiment, the weight compensation control system is adapted to stop the downward movement of the motion arm, in particular of the mobile base of the motion arm, when the tubular stand contacts the tubular string and the grippers are at a predetermined spinning height relative to the motion arm. In such an embodiment, the downward movement of the motion arm assembly, more in particular of the motion base of the motion arm assembly, is sued to provide the grippers with a spinning height relative to the motion arm, to allow for the weight compensation system to use the compensator pistons to control the weight transfer while the tubular stand is connected to the tubular string, e.g. during the spinning process.

In an alternative embodiment, the weight compensation control system is adapted to position the pin end of the tubular stand adjacent the box end of the tubular string, by lowering the motion arms, to land the tubular stand on the tubular string by lowering the grippers relative to the motion arm, and to stop lowering the pressure when a predetermined stand weight support pressure is reached to prevent the full weight of the tubular stand to be transferred onto the tubular string. In such an embodiment the compensator pistons instead of the mobile base are used to land the tubular stand on the tubular string. It is submitted that this requires the compensator pistons to lift the grippers, and thus the tubular stand supported by the grippers, prior to the tubular stand contacting the tubular string.

In a further preferred embodiment, the compensator pistons lift the grippers to an extend that there is also provided a predetermined spinning height, i.e. allow for the compensator pistons to lower the grippers relative to the motion arm during the tubular stand being connected to the tubular string, to keep the support pressure, and thus the weight transferred to the tubular string substantially constant during that process.

In such an embodiment, the weight compensation control system is configured to reduce the pressure in the compensator pistons to lower the pin end of the tubular stand into the box end of the tubular string during spinning in, and to increase the pressure in the compensator pistons to lift the pin end of the tubular stand out of the box end of the tubular string during spinning out.

In an embodiment, the weight compensation control system is configured to keep the pressure at a substantially constant predetermined spinning in pressure during spinning in, and at a substantially constant predetermined spinning out pressure during spinning out. The spinning in pressure and the spinning out pressure may differ from the tubular stand weight support pressure provided while the tubular stand is landed on the tubular string. For example, in an embodiment, the tubular stand support pressure is such that 90% of the weight of the tubular stand is transferred to the motion arms during the landing process, while 80% of the weight of the tubular stand is transferred to the motion arms during the spinning in of the tubular stand.

In a further embodiment, the weight compensation control system is linked to a spinner and/or a torque wrench for securing the tubular stand to the tubular string, to receive torque data, and wherein the pressure in the compensator pistons is controlled based on the torque data.

In an embodiment, the weight compensation control system controls the pressure in the compensator pistons based on spinning data received from the gripper member, e.g. the position of the grippers relative to the mobile base, the rotation of the stand about its tubular axis, etc.

In an embodiment, the weight compensation control system comprises one or more sensors that provide information on the pressure in the compensation pistons and/or the load supported by the grippers.

In an embodiment, the tubular stand handling system further comprises a tubular stand rotation device for rotating the tubular in order to facilitate connection of the tubular stand to the tubular string. For example, the grippers may be adapted to not only rotatable support the tubular stand but also rotate the tubular stand, e.g. be provided with a drive that rotates one or more of the rollers of the grippers to thus rotate the tubular stand supported by the gripper. In addition, or as an alternative, a spinning device is provided on one or more of the motion arm assemblies.

The invention furthermore provides a tubular stand handling system for providing a drilling rig according to the invention.

The invention furthermore provides a gripper member and a control system for providing a tubular stand handling system according to the invention. Thus, for example, a drilling rig provided with a prior art tubular stand handling system can be provided with a gripper members and a tubular stand weight compensation control system to provide a tubular stand handling system according to the invention.

The invention furthermore provides a method for landing a tubular stand on a tubular string using a drilling rig according to one or more of the preceding claims, the method comprising the steps:

engaging the tubular stand with the grippers of the motion arm assemblies;

actuate the compensator pistons to provide predetermined stand weight support pressure;

lift the tubular stand, move tubular stand into the firing line, and position the tubular stand above the tubular string supported in the slip device, using the motion arm assemblies;

land the tubular stand on the tubular string by lowering the motion arm assemblies and/or the grippers in a downward direction;

keep the predetermined stand weight support pressure substantially constant when the tubular stand contacts the tubular string to thus transfer only part of the weight of the stand onto the tubular string while supporting the rest of the weight with the motion arm assemblies.

A further method according to the invention comprises connecting the tubular stand to the tubular string, the method comprising the steps:

spinning the tubular stand while using the compensator pistons to lower the pin end of the tubular stand into the box end of the tubular string, keeping the stand weight support pressure substantially constant while lowering the tubular stand;

after the tubular stand has been secured to the tubular string, reduce the pressure in the compensator pistons to transfer the full weight of the tubular stand on the tubular string;

release the tubular stand with the grippers of the motion arm assemblies.

In an embodiment, a method according to the invention comprises the steps:

during landing on and connecting to the tubular string, keeping the percentages of weight of the tubular stand transferred to the tubular string below the 30%, for example at 25%, more preferably below the 20%, for example at 15, most preferably below 10%, for example at 5%.

In an embodiment, a method according to the invention comprises the steps:

use the compensator pistons to land the tubular stand on the tubular string, while only part of the weight of the tubular stand is transferred to the tubular string.

A further method according to the invention comprises the steps:

prior to landing the tubular stand on the tubular string:

actuate the compensator pistons by increasing the pressure in the compensator pistons until pressure remains constant;

further increase pressure in the compensator pistons, moving the grippers and the tubular stand supported by the grippers upwards relative to the motion arm, when the grippers have at least obtained a predetermined spinning height relative to the motion arm, lower the motion arm assemblies in the downward direction to position the pin end of the tubular stand adjacent to, but spaced from, the box end of the tubular string; and land the tubular stand on the tubular string using the compensator pistons.

An alternative method according to the invention comprises the steps:

use the motion arm assemblies to land the tubular stand on the tubular string, while only part of the weight of the tubular stand is transferred to the tubular string.

A further method according to the invention comprises the steps:

prior to landing the tubular stand on the tubular string:

actuate the compensator pistons by increasing the pressure in the compensator pistons to provide predetermined stand weight support pressure, which stand weight support pressure is less than 100% of the tubular stand weight, e.g. 90% of the stand weight;

lower the motion arm assembly in the downward direction to land the tubular stand on the tubular string.

A further method according to the invention comprises the steps:

after the tubular stand has landed on the tubular string, further lower the motion arm assemblies while keeping the stand weight support pressure substantially constant, and thus keep the weight transferred onto the tubular string substantially constant, thus moving the grippers upwards relative to the motion arm;

when the grippers have obtained a predetermined spinning height relative to the motion arm, stop the movement of the motion arm assembly in the downward direction.

Whilst primarily presented for illustrative purposes with reference to one or more of the figures, any of the technical features addressed below may be combined with any of the independent claims of this application either alone or in any other technically possible combination with one or more other technical features.

Advantageous embodiments of the drilling rig according to the invention and the method according to the invention are disclosed in the sub claims and in the description, in which the invention is further illustrated and elucidated on the basis of a number of exemplary embodiments, of which some are shown in the schematic drawing. In the figures, components corresponding in terms or construction and/or function are provided with the same last two digits of the reference numbers.

DETAILED DESCRIPTION

Figure 1:
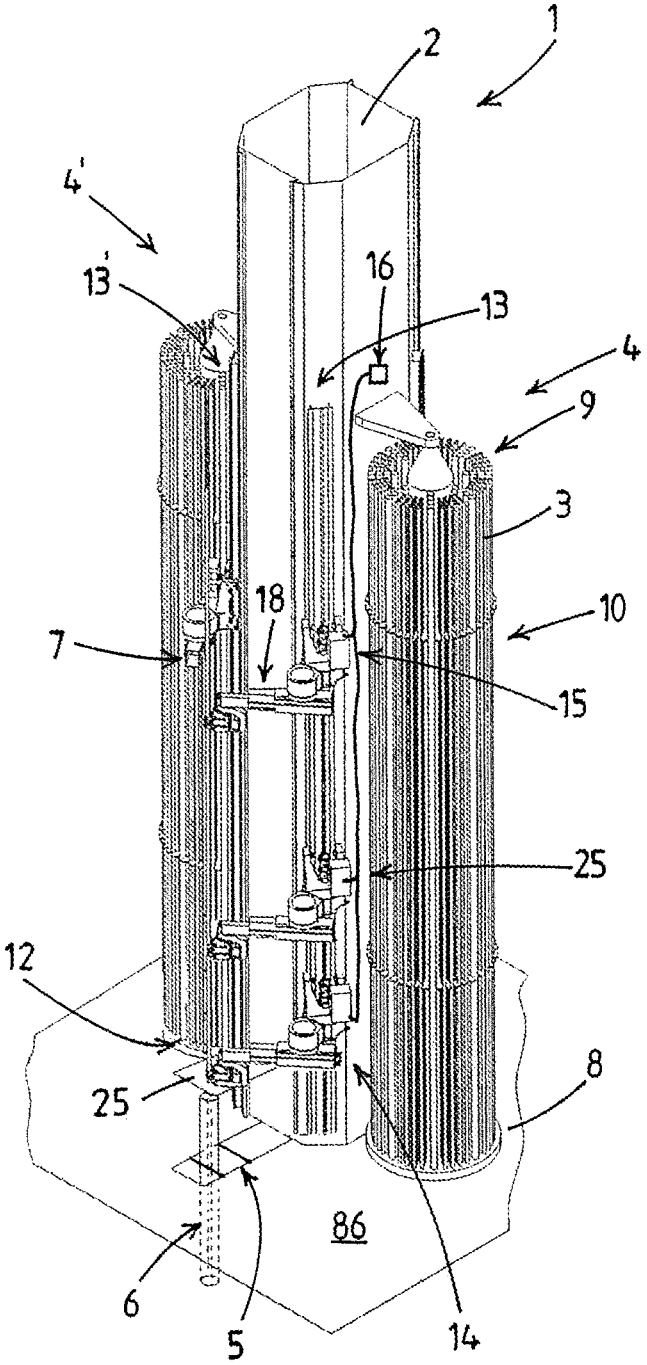
FIG. 1 shows a perspective view of an exemplary embodiment of a drilling rig according to the invention.

FIG. 1 shows a perspective view of an exemplary embodiment of a drilling rig 01 according to the invention.

The drilling rig 1 comprises a tubular stand support tower in the form of a multipurpose tower 2, a tubular stand storage rack 3 supporting tubular stand 4 on each side of the multipurpose tower, a tubular string slip device 5 supporting a tubular string 6, a tubular stand connection device 7 and a tubular stand handling system 8.

In the embodiment shown, the tubular stand support tower is embodied as a multipurpose tower, configured to handle different types of tubulars, e.g. drilling tubulars and casing tubulars, and to compose insert a string of tubular stands into a well bore and remove a string of tubular stand from a well bore. The multipurpose tower is furthermore adapted to assist in drilling a wellbore, e.g. by supporting and driving a drilling string.

The multipurpose tower defines a firing line 12 alongside a frontal surface. The firing line is concentric with the slip device 5 supporting the tubular string 6. The tubulars string slip device 5 is adapted to support the weight of a tubular string comprising multiple tubular stands.

The multipurpose tower 2 is on opposite sides provided with the tubulars stand storage racks 4, in the embodiment shown in the form of carousels, adapted for storage of tubular stands 3, e.g. sets of combined drilling tubulars, in vertical orientation therein.

The tubular stand connecting device 7, is adapted to connect a lower pin end 9 of the tubular stand 3 to an upper box end 10 of the tubular string 6 supported in the firing line 12 by the slip device 5. The tubular stand connection device is adapted to extend the tubular string, during tripping in, and/or to disconnect the lower pin end of the tubular stand from the upper box end of the tubular string, to shorten the tubular string during tripping out. The tubular stand connection device 7 can be a power tong and/or a spinner and/or a torque wrench or a combination of two or more of these.

The tubular stand handling system 8 is adapted to move a tubular stand 3 between the storage rack 4 and a position in the firing line 12 above the tubular string slip device 5. The tubular stand handling system 8 is furthermore adapted to rotatable support the tubular stand 3 in the firing line 12 during spinning in, to allow for connecting the tubular stand 3 with the tubular string 6, and during spinning out, to allow for disconnecting the tubular stand 3 from the tubular string 6.

The tubular stand handling system 8 comprises vertical rails 13, a lower motion arm assembly 14, an upper motion arm assembly 15, and a weight compensation control system 16.

In the particular embodiment shown, the multi purpose tower 2 is provided with two vertical rails 13, each mounted to the multi purpose tower along at least part of the firing line. The rails are each provided with motion arm assemblies.

In the embodiment shown, the right vertical rails 13 is provided with the lower motion arm assembly 14 and the upper motion arm assembly 15 of the tubular stand handling system, to move tubulars from the tubular stand storage rack located on the right side of the multipurpose tower into the firing line.

The lower motion arm assembly 14 and an upper motion arm assembly 15 are moveably mounted on the vertical rails for respectively engaging a tubular stand at a lower region and at an upper region thereof.

In the preferred embodiment shown, the tubular stand handling system 8 is furthermore provided with a third motion arm assembly 25, supported on the vertical rails 13 above the lower motion arm assembly 14 and below the upper motion arm assembly 15, for engaging a tubular stand at a mid-section thereof.

The left vertical rails 13' is provided with a motion arm assembly 14' that supports a tubular stand connection device in the form of a torque wrench combined with a spinner 7 (not shown in detail). It is submitted that the motion arm assembly supporting the tubular stand connection device is shown in a raised position. When the connection device is active, i.e. is connecting or disconnecting a tubular stand, it is supported by the motion arm assembly in a position closer to the slip device, more in particular at the top end of the tubular string supported in the slip device.

Figure 2:
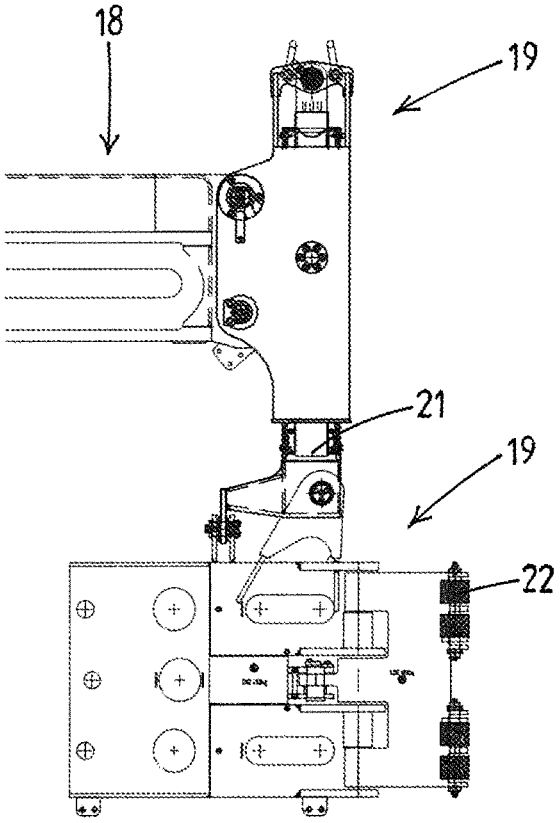
FIG. 2 shows a side view of an exemplary embodiment of a gripper member according to the invention.
Figure 3:
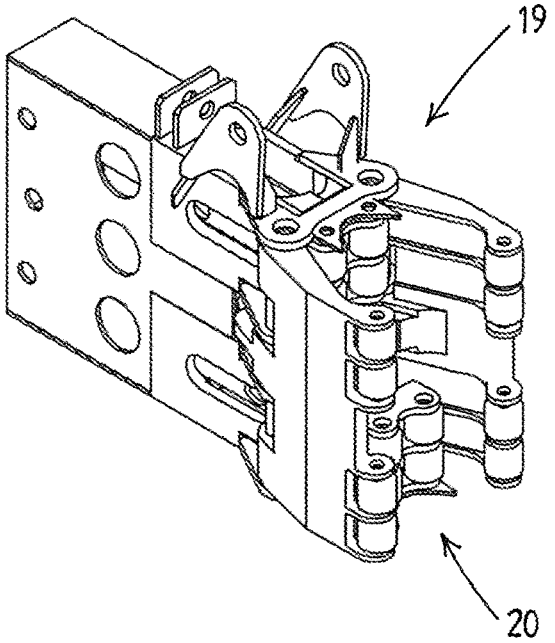
FIG. 3 shows a perspective view of the gripper of FIG. 2.
Figure 4:
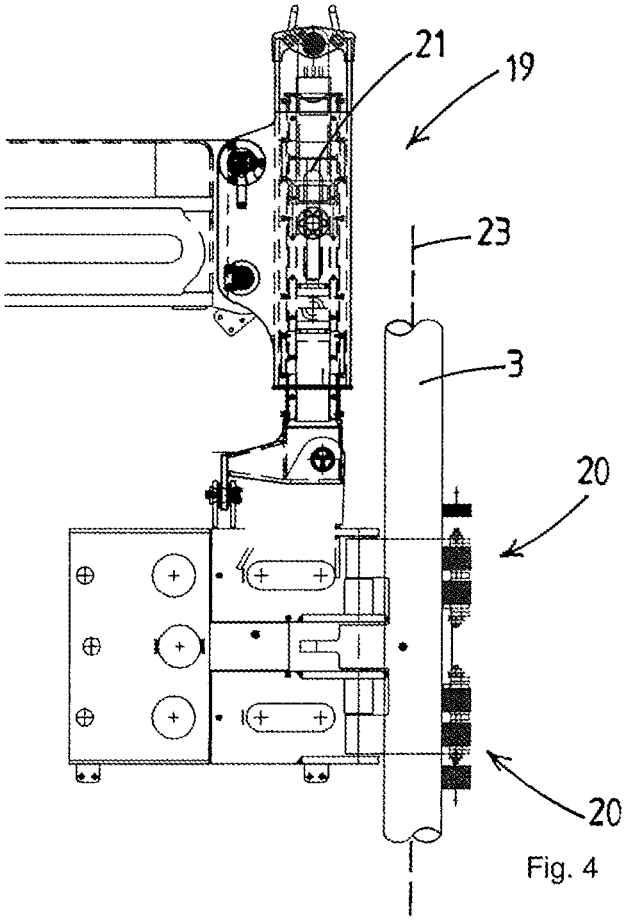
FIG. 4 shows a side view of the gripper of FIG. 2 engaging a tubular stand.

The motion arm assemblies are partially shown in detail in FIGS. 10-13. Each motion arm assembly comprises a mobile base 17, a motion arm 18, and a tubular gripper member 19. The latter is shown in detail in FIGS. 2 and 3.

The mobile base 17 of a motion arm assembly is supported by the vertical rails 13, and is vertically mobile along said vertical rails by a vertical drive including a motor, which vertical drive is positioned on said mobile base.

Figure 12:
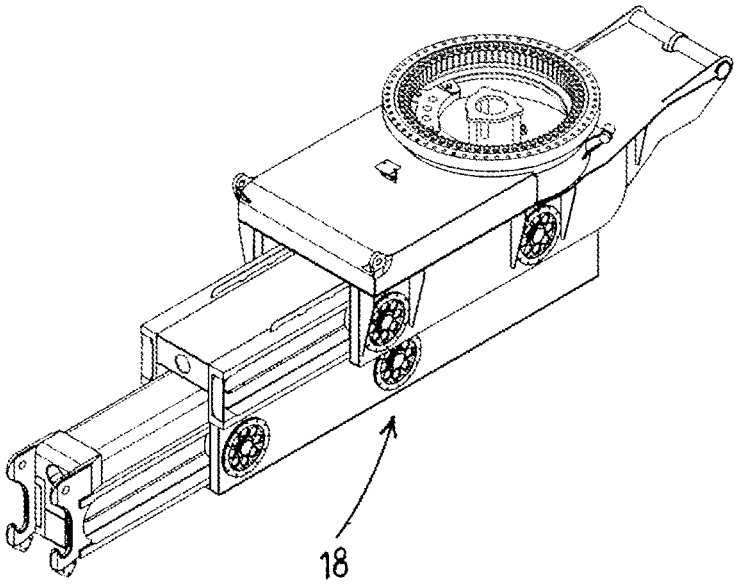
FIG. 12 shows a perspective view of a motion arm of the motion arm assembly of FIG. 10.
Figure 13:
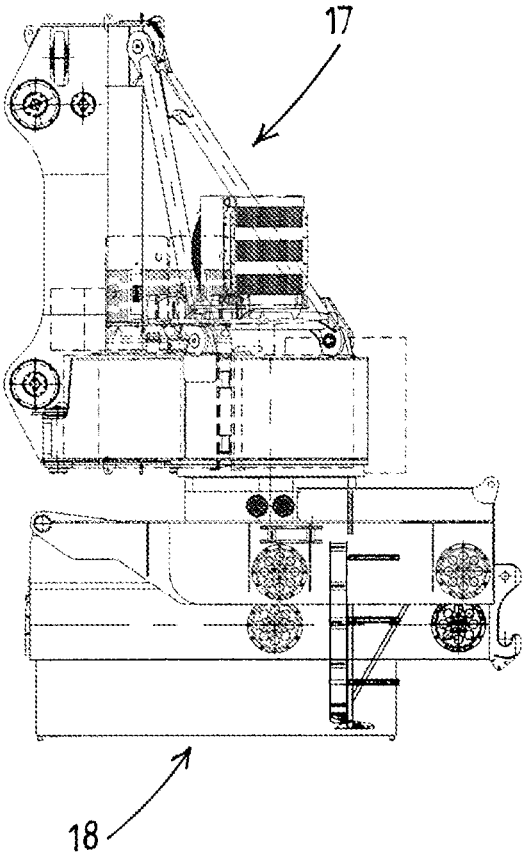
FIG. 13 shows a side view of the motion arm assembly of FIG. 10.

The motion arm 18, shown in isolation in FIG. 12, is connected to the mobile base 17. In the embodiment shown, the motion arm 18 is pivotably connected to the mobile base 17 for pivoting about a vertical axis. Thus, the motion arm assemblies are configured to move a tubular stand into and out of the firing line by pivoting the motion arm about the vertical axis. In the embodiment shown, the motion arms furthermore are telescopic arms. The motion arm 18 is shown in an extended configuration in FIG. 12 and in a retracted position in FIGS. 10, 11 and 13.

In the embodiment shown, the mobile arm assemblies on the rails 13, on the right side of the tower, are provided with gripper members according to the invention. The tubular gripper members 19 are connected to the motion arm 18 of the mobile arm assemblies.

In the embodiment shown, the motion arm assemblies are configured to move independently from each other and are adapted to support different tools. Thus, the gripper members can be replaced with different tool when needed.

Figure 5:
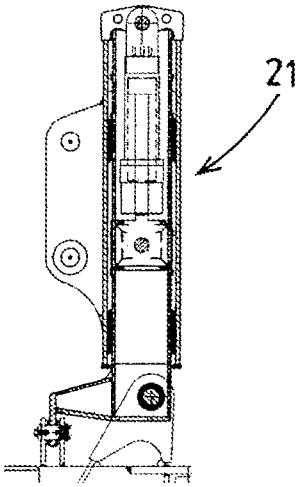
FIG. 5 shows in cross section a compensator piston of the gripper member of FIG. 2 in a retracted position.
Figure 6:
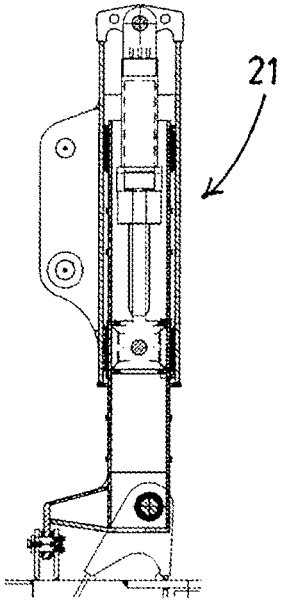
FIG. 6 shows in cross section the compensator piston of FIG. 5 in an extended position.
Figure 7:
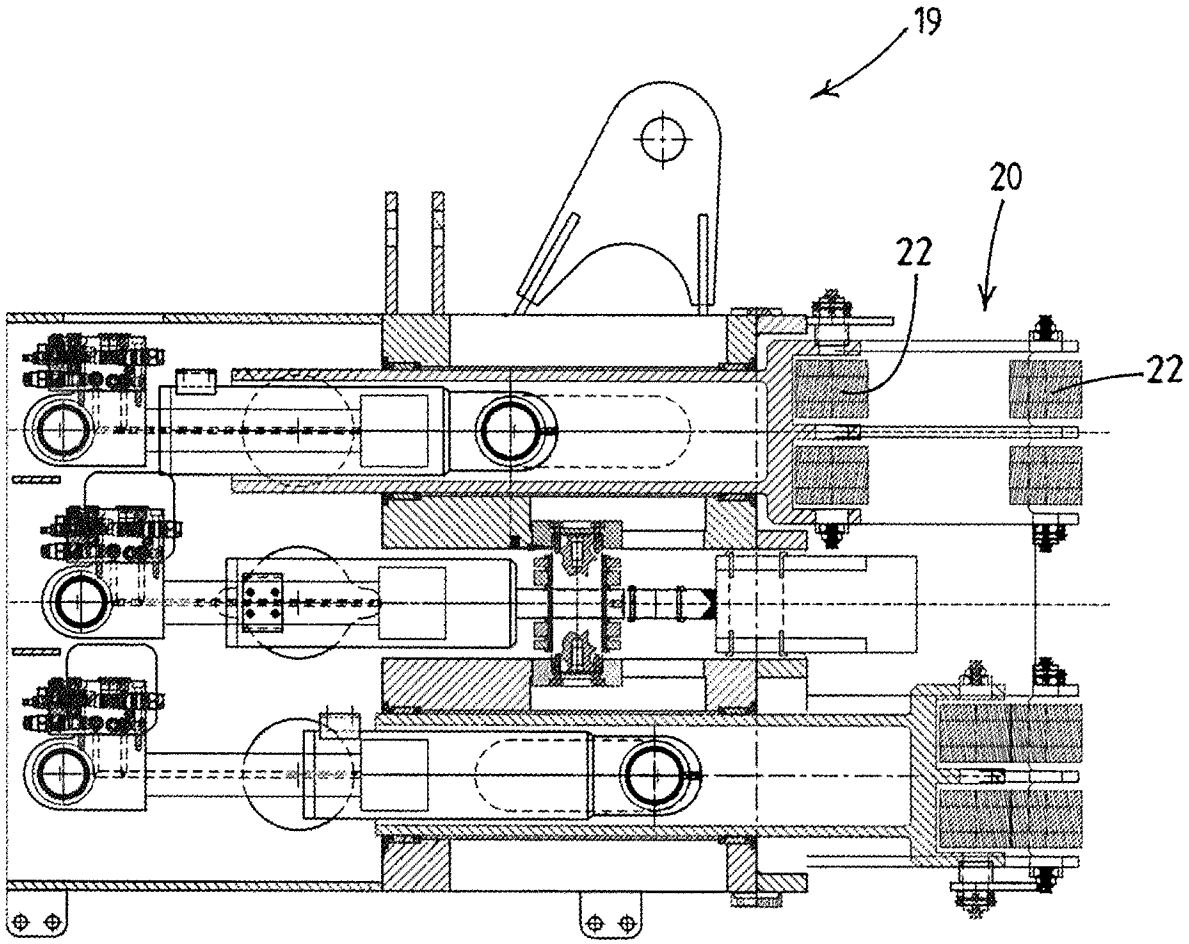
FIG. 7 shows in cross section the gripper member of FIG. 2.
Figure 8:
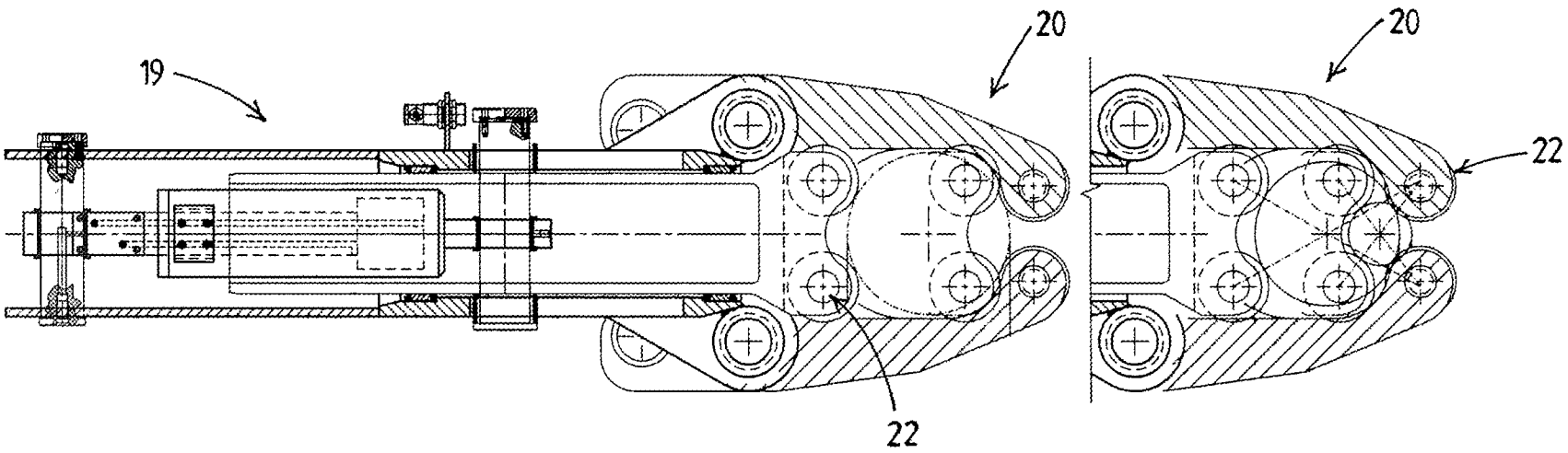
FIG. 8 shows a top view of the gripper member of FIG. 2 with grippers engaging a tubular with a first diameter and engaging a tubular with a second diameter
Figure 9:
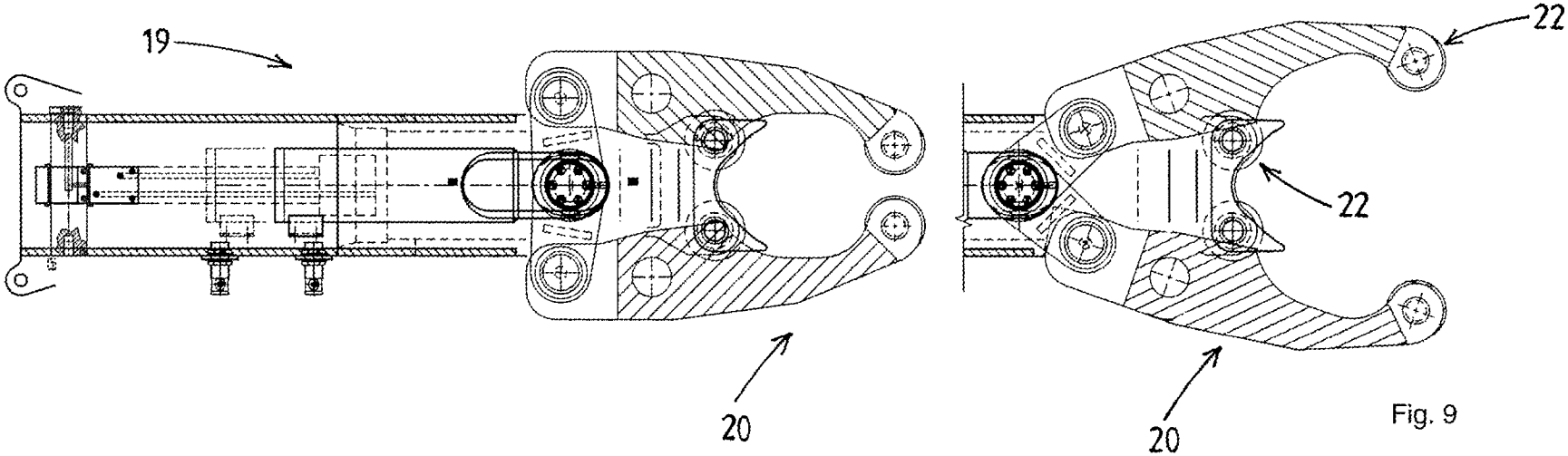
FIG. 9 shows a top view of the gripper member of FIG. 2 with closed grippers and with opened grippers.
Figure 10:
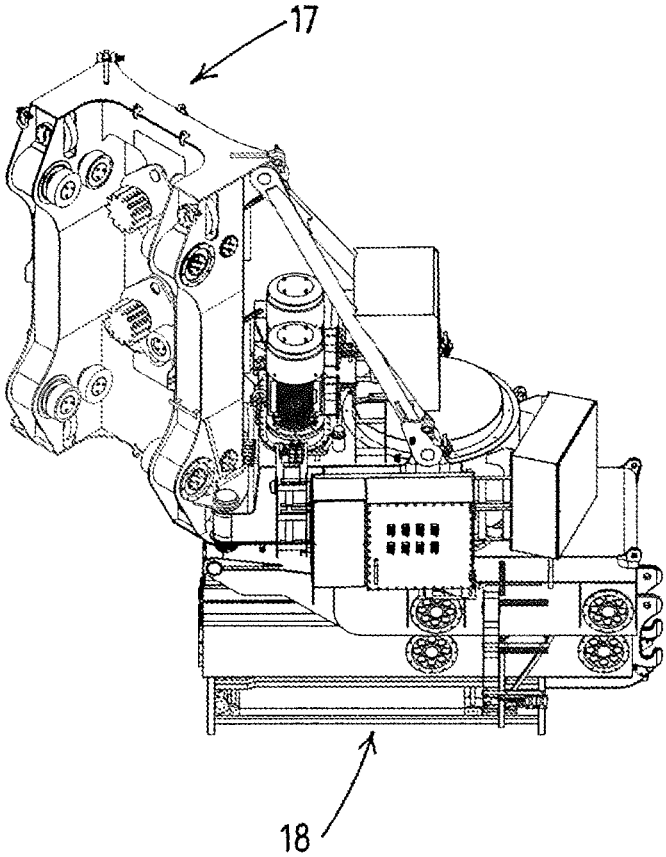
FIG. 10 shows a perspective view of an exemplary embodiment of a motion arm assembly according to the invention.
Figure 11:
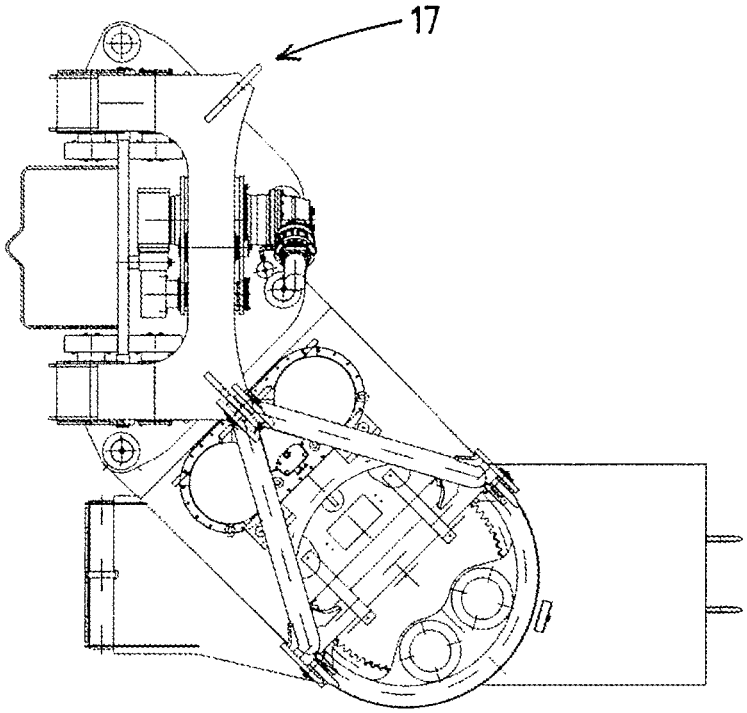
FIG. 11 shows a top view of the motion arm assembly of FIG. 10.

According to the invention, the gripper members 19 comprise grippers 20, shown in detail in FIGS. 2, 3 and 7-9, and one or more compensator pistons 21, shown in detail in FIGS. 5 and 6.

The grippers 20 are configured for engaging a tubular section 11 of a tubular stand 3, and are provided with rollers 22 to enable the gripper to support a tubular section of a tubular stand 3 along a longitudinal axis 23 of that tubular stand while allowing rotation of that tubular section about that longitudinal axis.

According to the invention, the grippers 20 are movably supported for movement relative to the mobile base 17 in a compensation direction directed substantially parallel to the firing line 12.

The gripper members 19 further comprises one or more compensator pistons 24 for moving the grippers 20 relative to the mobile base 17, and preferably relative to the motion arm 18, in the compensation direction. The one or more compensator pistons 24 are configured to support the weight of the grippers and at least part of the weight of the tubular stand engaged by the grippers.

In the preferred embodiment shown, see for example FIGS. 5 and 6, the grippers 20 are supported by the compensator pistons 21, more in particular are hingeably connected to a lower end of the vertically orientated compensator piston. Thus, the grippers are moved by the compensator pistons along a weight support trajectory that extends parallel to the firing line and to a line of action of the piston, i.e. the central axis of the piston.

According to the invention, the tubular stand handling system 8 comprises the weight compensation control system 16, which control system controls the compensator pistons 24 of the motion arm assemblies, and which control system is adapted to increase the pressure in the compensator pistons when the tubular stand is landed on the tubular string, by moving the motion arm assembly and/or the grippers supporting the tubular stand downward, to prevent the full weight of the tubular stand from being transferred onto the tubular string.

Thus, the tubular stand handling system can be used to land the tubular stand on the tubular string by moving the motion arm assemblies and/or by moving the grippers in a downward direction along the firing line. In a preferred embodiment, the tubular stand is landed on the tubular string by lowering the motion arm assembly, and the tubular stand is moved downward while being connected to the tubular string by lowering the grippers relative to the motion base of the motion arm assemblies, using the compensator pistons.

According to the invention, during landing of the tubular stand on the tubular string, during connecting the tubular stand to the tubular string, and during disconnecting the tubular stand form the tubular string, the weight compensation control system, more in particular the compensator pistons of the weight compensation control system, can be used to compensate part of the weight of the tubular stand, and thus prevent the full weight of the tubular stand to bear down on the tubular string while the tubular stand is not fully connected to the tubular string.

Thus, the multipurpose tower shown in the figures, more in particular the tubular stand handling system of the multipurpose tower, can be used for landing a tubular stand on a tubular string using a method according to the invention, the method comprising the steps:

engaging the tubular stand 3 with the grippers 20 of the motion arm assemblies 14,15,25;

actuate the compensator pistons 21 to provide predetermined stand weight support pressure;

lift the tubular stand 3, move tubular stand 3 into the firing line 12, and position the tubular stand 3 above the tubular string 6 supported in the slip device 5, using the motion arm assemblies 14,15,25;

land the tubular stand 3 on the tubular string 6 by lowering the motion arm assemblies 14,15,25 and/or the grippers 20 in a downward direction;

keep the predetermined stand weight support pressure substantially constant when the tubular stand 3 contacts the tubular string 6 to thus transfer only part of the weight of the tubular stand 3 onto the tubular string 6 while supporting the rest of the weight with the motion arm assemblies 14,15,25.

Furthermore, the multipurpose tower shown in the figures, more in particular the tubular stand handling system of the multipurpose tower, can be used for connecting the tubular stand to the tubular string, the method comprising the steps:

spinning the tubular stand 3 while using the compensator pistons 21 to lower the pin end 9 of the tubular stand 3 into the box end 10 of the tubular string 6, keeping the stand weight support pressure substantially constant while lowering the tubular stand 3;

after the tubular stand 3 has been secured to the tubular string 6, reduce the pressure in the compensator pistons 21 to transfer the full weight of the tubular stand 3 on the tubular string 6;

release the tubular stand 3 with the grippers 20 of the motion arm assemblies 14, 15, 25.

In a further preferred method according to the invention, the motion arm assemblies are used to land the tubular stand on the tubular string, while only part of the weight of the tubular stand is transferred to the tubular string. Such a method comprises the steps:

prior to landing the tubular stand on the tubular string:

actuate the compensator pistons by increasing the pressure in the compensator pistons to provide predetermined stand weight support pressure, which stand weight support pressure is less than 100% of the tubular stand weight, e.g. 90% of the stand weight;

lower the motion arm assembly in the downward direction to land the tubular stand on the tubular string;

and preferably, after the tubular stand has landed on the tubular string, further lower the motion arm assemblies while keeping the stand weight support pressure substantially constant, and thus keep the weight transferred onto the tubular string substantially constant, thus moving the grippers upwards relative to the motion arm; and when the grippers have obtained a predetermined spinning height relative to the motion arm, stop the movement of the motion arm assembly in the downward direction.

Figure 14:
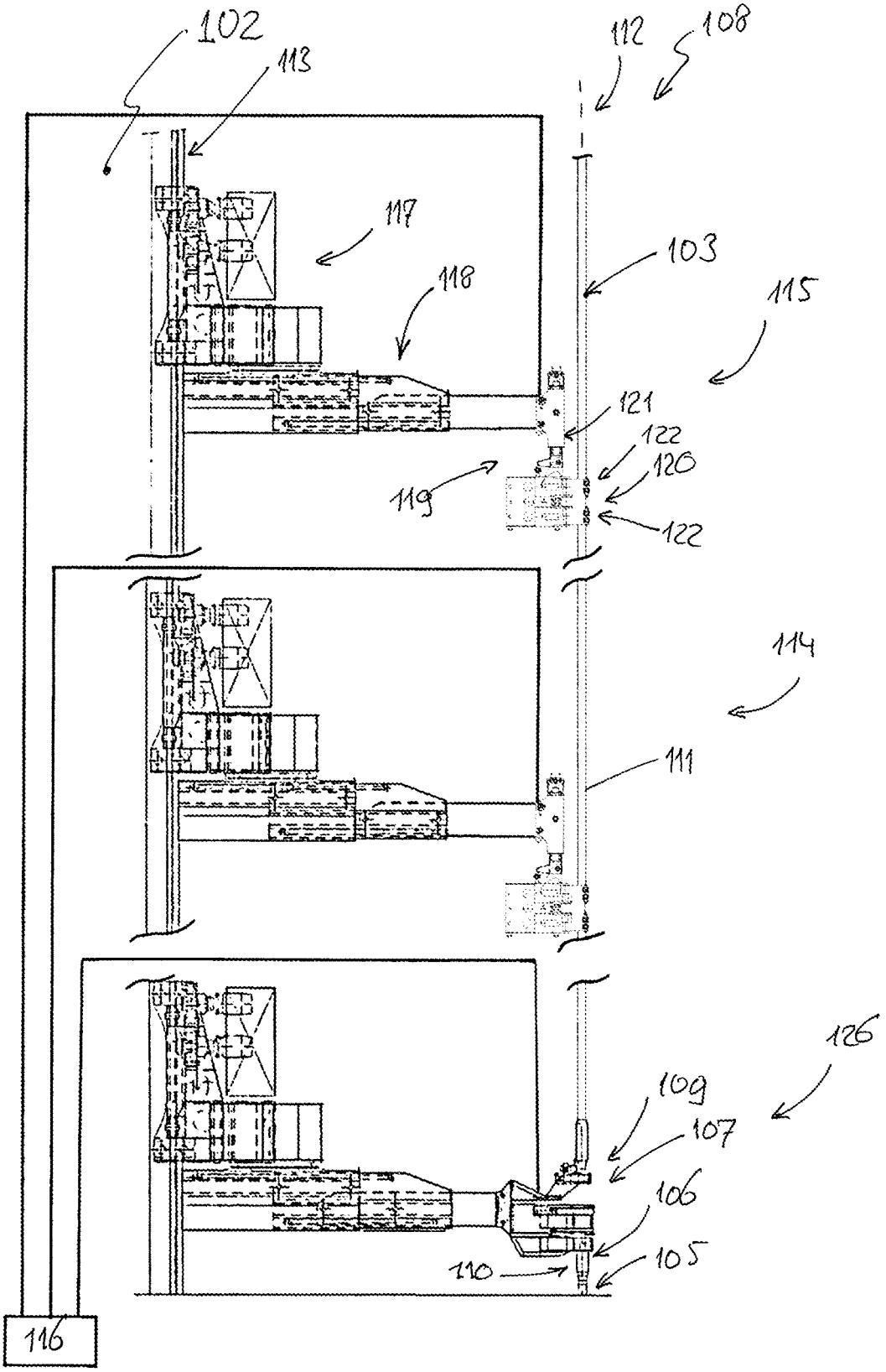
FIG. 14 shows a partial side view of an exemplary embodiment of a drilling rig according to the invention.

FIG. 14 shows a partial side view of an exemplary embodiment of a drilling rig according to the invention, more in particular shows parts of a tubular stand support tower in the form of a drilling tower 102, a tubular string slip device 105 supporting a tubular string 106, a tubular stand connection device 107 and a tubular stand handling system 108.

The drilling tower 102 defines a firing line alongside a frontal surface of the drilling tower. The firing line is concentric with the slip device 105 supporting the tubular string 106. The tubulars string slip device 105 is adapted to support the weight of a tubular string comprising multiple tubular stands.

The tubular stand handling system 108 comprises a vertical rails 113, mounted to the drilling tower 102 along at least part of the firing line, a lower motion arm assembly 114 and an upper motion arm assembly 115, mounted on the vertical rails 113.

In the embodiment shown, the tubular stand handling system 108 is adapted to support the tubular stand 103 in a lower region and in an upper region thereof. The lower motion arm assembly 114 and the upper motion arm assembly 115 engage a tubular stand 103 at a lower region and an upper region of the tubular stand. This is in particular beneficial when manipulating long, and thus comparatively flexible, tubular stands.

In a further embodiment, an additional motion arm assemblies, also controlled by the weight compensation control system, to provide additional support and/or allow for handling extra-long pipe stand. For example, the tubular stand handling system may comprise a third, intermediate motion arm assembly, located above the lower motion arm assembly and below the upper motion arm assembly on the vertical rail, to support the tubular stand at a mid-section.

In the embodiment shown, an additional motion arm assembly 126 is provided to support the tubular stand connection device 107. The third motion arm assembly 126 is located below the lower motion arm assembly 114 and the upper motion arm assembly 115 on the vertical rails 113.

The tubular stand connecting device 107, is adapted to connect and to disconnect a lower pin end 109 of the tubular stand 103 supported by the tubular stand handling system respectively to and from an upper box end 110 of the tubular string 106 supported in the firing line 112 by the slip device 105.

Both the lower motion arm assembly 114 and the upper motion arm assembly 115 comprise a motion arm 118 and a tubular gripper member 119. The gripper member 119 is connected to the motion arm 118 of the mobile arm assemblies 114,115.

In the embodiment shown, the motion arm assemblies are configured to move independently from each other and are adapted to support different tools. The gripper members can be replaced with a different tool when needed. According to the invention, the gripper members 119 comprise grippers 120 and a compensator piston 121.

The grippers 120 are provided with rollers 122 to enable the gripper to support the tubular stand 103 while allowing rotation of that tubular stand about its longitudinal axis.

The grippers 120 are movably supported by the compensator piston 121 for movement relative to the respective motion arm assemblies 114,115 in a compensation direction directed substantially parallel to the firing line 12.

The one or more compensator pistons 124 are configured to support the weight of the grippers and at least part of the weight of the tubular stand engaged by the grippers.

A weight compensation control system 116 controls the compensator pistons 121 of the lower motion arm assembly 114 and the upper motion arm assembly 115.

The weight compensation control system is adapted to increase the pressure in the compensator pistons when the tubular stand is landed on the tubular string, by moving the motion arm assembly and/or the grippers supporting the tubular stand downward, to prevent the full weight of the tubular stand from being transferred onto the tubular string.

Thus, during landing of the tubular stand on the tubular string, during connecting the tubular stand to the tubular string, and during disconnecting the tubular stand form the tubular string, the weight compensation control system, more in particular the compensator pistons of the weight compensation control system, can be used to compensate part of the weight of the tubular stand, and thus prevent the full weight of the tubular stand to bear down on the tubular string while the tubular stand is not fully connected to the tubular string.

The weight compensation control system comprises a hydraulic power system for actuating the compensator pistons. The lower motion arm assembly and the upper motion arm assembly are each provided with a hydraulic power system, which are linked to the weight compensation control system. Linking them to the weight compensation control system allows for the motion arm assemblies to operate in unison. i.e. to enable synchronous movement of the grippers and control of even load sharing over the assemblies.

In the embodiment shown, the weight compensation control system 116 is also linked with the tubular stand connecting device 107 to use the tubular stand connecting device in conjunction with the pipe handling system.

In the embodiment shown, the tubular stand connecting device is torque wrench with a spinner, supported by the third motion arm assembly 126, for securing the tubular stand to the tubular string.

The weight compensation control system is linked to the spinner and the torque wrench to receive torque data. Thus, the pressure in the compensator pistons can be controlled based on the torque data. Also, the weight compensation control system can control the pressure in the compensator pistons based on spinning data received from the gripper member, e.g. the position of the grippers relative to the mobile base, the rotation of the stand about its tubular axis, etc.

In the embodiment shown, the tubular stand connecting device is torque wrench with a spinner. In addition, or as an alternative, the tubular stand handling system may further comprise a tubular stand rotation device for rotating the tubular in order to facilitate connection of the tubular stand to the tubular string.

In the embodiment shown, the weight compensation control system 116 is furthermore provided with sensors (not shown) for providing operational information of the compensator pistons, e.g. pressure information and/or position information or load information and with sensors that provide information on the load supported by the grippers.

The weight compensation control system 116 can be used to adjust the percentage of the stand weight transferred onto the tubular string during the spinning process. For example, if at the beginning of the spinning process the torque required for rotating the tubular stand is relatively high, the amount of transferred stand weight may be reduced in order to lower friction, and thus reduce the required torque, which may prevent damage to the threads.

The tubular stand handling system 108 can land the tubular stand 103 on the tubular string 106 by lowering the upper motion arm assembly 115 and the lower motion arm assembly 114, i.e. moving the motion arm assemblies in a downward direction along the rails, and, subsequently, while the tubular stand 103 is being connected to the tubular string 106, move the tubular stand further downward by lowering the grippers 120 relative to the respective motion arm assemblies, using the compensator pistons 121.

Also, the multipurpose tower shown in FIG. 14, more in particular the tubular stand handling system of the multipurpose tower, can be used for landing a tubular stand on a tubular string using a method according to the invention, the method comprising the steps:

engaging the tubular stand 103 with the grippers 120 of the respective motion arm assemblies 114,115;

actuate the respective compensator pistons 121, to provide predetermined stand weight support pressure;

lift the tubular stand 103, move tubular stand 103 into the firing line 112, and position the tubular stand 103 above the tubular string 106 supported in the slip device 105, using the motion arm assemblies 114,115;

land the tubular stand 103 on the tubular string 106 by lowering the motion arm assemblies 114,115 relative to the drilling tower and/or by lowering the grippers 120 relative to the motion arm assemblies;

keep the predetermined stand weight support pressure substantially constant when the tubular stand 103 contacts the tubular string 106 to thus transfer only part of the weight of the tubular stand 103 onto the tubular string 106 while supporting the rest of the weight with the motion arm assemblies 114,115.

REFERENCE SIGNS

01 drilling rig
02 tubular support tower
03 tubular stand
04 tubular stand storage rack
05 tubular string slip device
06 tubular string
07 tubular stand connection device
08 tubular stand handling system
09 pin end tubular
10 box end tubular
11 tubular section tubular
12 firing line
13 vertical rails
14 lower motion arm assembly
13 upper motion arm assembly
16 weight compensation control system
17 mobile base
18 motion arm
19 gripper member
20 grippers
21 compensator piston
22 rollers
23 longitudinal axis tubular stand
25 intermediate motion arm assembly
102 tubular support tower
103 tubular stand
105 tubular string slip device
106 tubular string
107 tubular stand connection device
108 tubular stand handling system
109 pin end tubular
110 box end tubular
111 tubular section tubular
112 firing line
113 vertical rails
114 lower motion arm assembly
115 upper motion arm assembly
116 weight compensation control system
117 mobile base
118 motion arm
119 gripper member
120 grippers
121 compensator pistons.
122 rollers
123 longitudinal axis tubular stand
125 intermediate motion arm assembly
126 third motion arm assembly

The invention claimed is:

1. A drilling rig, the drilling rig comprising:

a tubular stand support tower, the tubular stand support tower defining a firing line;

a tubular stand storage rack adapted for storage of tubular stands in vertical orientation therein, and wherein the tubular stand storage rack holds a plurality of tubular stands;

a tubular string slip device, the slip device being adapted to support the weight of a tubular string suspended therefrom in the firing line;

a tubular stand connecting device adapted to connect a lower pin end of one of the plurality of tubular stands to an upper box end of a tubular string supported in the firing line by the slip device, to extend the tubular string during tripping in, and/or to disconnect the lower pin end of the one of the plurality of tubular stands from the upper box end of the tubular string, to shorten the tubular string during tripping out; and a tubular stand handling system, adapted to move one of the plurality of tubular stands between the storage rack and a position in the firing line above the tubular string slip device, and adapted to rotatably support the one of the plurality of tubular stands in the firing line during spinning in, to allow for connecting the one of the plurality of tubular stands with the tubular string, and during spinning out, to allow for disconnecting the one of the plurality of tubular stands from the tubular string, the tubular stand handling system comprising:

vertical rails, mounted to the tubular stand support tower along at east part of the firing line; and a lower motion arm assembly and an upper motion arm assembly, mounted on said vertical rails for respectively engaging one of the plurality of tubular stands at a lower region and an upper region thereof, wherein each motion arm assembly comprises:

a mobile base, the mobile base being supported by the vertical rails, and being vertically mobile along said vertical rails by a vertical drive including a motor, the vertical drive being positioned on said mobile base;

a motion arm being connected to said mobile base; and a tubular gripper member being connected to the motion arm, wherein the gripper member comprises:

grippers for engaging a tubular section of one of the plurality of tubular stands, the grippers being movably supported for movement relative to the mobile base in a compensation direction directed parallel to the firing line, and the grippers being provided with rollers to enable the grippers to support the tubular section of the one of the plurality of tubular stands along a longitudinal axis of the one of the plurality of tubular stands while allowing rotation of the tubular section about the longitudinal axis;

one or more compensator pistons, for moving the grippers relative to the mobile base in the compensation direction, wherein the one or more compensator pistons are configured to support the weight of the grippers and at least part of the weight of the one of the plurality of tubular stands engaged by the grippers; and a weight compensation control system, the control system controlling the compensator pistons of the lower motion arm assembly and the upper motion arm assembly, and the control system being adapted to increase the pressure in the compensator pistons when the one of the plurality of tubular stands is landed on the tubular string, by moving the lower motion arm assembly and the upper motion arm assembly and/or the grippers of the respective motion arm assemblies supporting the one of the plurality of tubular stands downward, to prevent the full weight of the one of the plurality of tubular stands from being transferred onto the tubular string.

2. The drilling rig according to claim 1, wherein the weight compensation control system is adapted to control the pressure in the compensator pistons, such that by an increase of the pressure the grippers are moved upward relative to the mobile base of the respective motion arm, to enable only part of the weight of the one of the plurality of tubular stands to be transferred onto the tubular string.

3. The drilling rig according to claim 1, wherein the grippers are supported by the compensator pistons, and the compensator pistons are configured to move the grippers along a weight support trajectory that extends parallel to the firing line and to a line of action of the compensator pistons.

4. The drilling rig according to claim 1, wherein the weight compensation control system is adapted to allow the one of the plurality of tubular stands to land on the tubular string by moving the motion arm assemblies in a downward direction along the vertical rails, and is adapted to actuate the compensator pistons when the one of the plurality of tubular stands contacts the tubular string such that not all of the weight of the one of the plurality of tubular stands is transferred onto the tubular string, and to keep the weight of the one of the plurality of tubular stands transferred onto the tubular string constant while the one of the plurality of tubular stands contacts the tubular string and the motion arm moves further downwards.

5. The drilling rig according to claim 4, wherein the weight compensation control system is adapted to stop the downward movement of the motion arm when the one of the plurality of tubular stands contacts the tubular string and the grippers are at a predetermined spinning height relative to the respective motion arm.

6. The drilling rig according to claim 1, wherein the weight compensation control system is adapted to position the pin end of the one of the plurality of tubular stands adjacent the box end of the tubular string, by lowering the motion arm, to land the one of the plurality of tubular stands on the tubular string by lowering the grippers relative to the motion arm, and to stop lowering the pressure in the compensator pistons when a predetermined tubular stand weight support pressure is reached to prevent the full weight of the one of the plurality of tubular stands to be transferred onto the tubular string.

7. The drilling rig according to claim 1, wherein the weight compensation control system is configured to reduce the pressure in the compensator pistons to lower the pin end of the one of the plurality of tubular stands into the box end of the tubular string during spinning in, and to increase the pressure in the compensator pistons to lift the pin end of the one of the plurality of tubular stands out of the box end of the tubular string during spinning out.

8. The drilling rig according to claim 1, wherein the weight compensation control system is configured to keep the pressure in the compensator pistons at a constant predetermined spinning in pressure during spinning in, and at a constant predetermined spinning out pressure during spinning out.

9. The drilling rig according to claim 1, wherein the weight compensation control system is linked to a spinner and/or a torque wrench for securing the one of the plurality of tubular stands to the tubular string, to receive torque data, and wherein the pressure in the compensator pistons is controlled based on the torque data.

10. The drilling rig according to claim 9, wherein the weight compensation control system controls the pressure in the compensator pistons based on spinning data received from the gripper member.

11. The drilling rig according to claim 1, wherein the tubular stand handling system further comprises a tubular stand rotation device for rotating the one of the plurality of tubular stands in order to facilitate connection of the one of the plurality of tubular stands to the tubular string.

12. A method for landing the one of the plurality of tubular stands on a tubular string using the drilling rig according to claim 1, the method comprising the steps of:

engaging the one of the plurality of tubular stands with the grippers of the motion arm assemblies;

actuating the compensator pistons to provide a predetermined tubular stand weight support pressure;

lifting the one of the plurality of tubular stands, moving the one of the plurality of tubular stands into the firing line, and positioning the one of the plurality of tubular stands above the tubular string supported in the slip device, using the motion arm assemblies;

landing the one of the plurality of tubular stands on the tubular string by lowering the motion arm assemblies and/or the grippers in a downward direction;

keeping the predetermined tubular stand weight support pressure constant when the one of the plurality of tubular stands contacts the tubular string to thus transfer only part of the weight of the one of the plurality of tubular stands onto the tubular string while supporting the rest of the weight with the motion arm assemblies.

13. The method according to claim 12, further comprising the steps of:

connecting the one of the plurality of tubular stands to the tubular string;

spinning the one of the plurality of tubular stands while using the compensator pistons to lower the pin end of the one of the plurality of tubular stands into the box end of the tubular string, keeping the tubular stand weight support pressure constant while lowering the one of the plurality of tubular stands;

after the one of the plurality of tubular stands has been secured to the tubular string, reducing the pressure in the compensator pistons to transfer the full weight of the one of the plurality of tubular stands on the tubular string; and releasing the one of the plurality of tubular stands with the grippers of the motion arm assemblies.

14. The method according to claim 12, further comprising the step of:

during landing on, and connecting to, the tubular string, keeping the percentages of weight of the one of the plurality of tubular stands transferred to the tubular string below 30%.

15. The method according to claim 12, further comprising the step of:

using the compensator pistons to land the one of the plurality of tubular stands on the tubular string, while only part of the weight of the one of the plurality of tubular stands is transferred to the tubular string.

16. The method according to claim 15, further comprising the steps of:

prior to landing the one of the plurality of tubular stands on the tubular string:

actuating the compensator pistons by increasing the pressure in the compensator pistons until the pressure in the compensator pistons remains constant;

further increasing pressure in the compensator pistons, moving the grippers and the one of the plurality of tubular stands supported by the grippers upwards relative to the respective motion arms;

when the grippers have at least obtained a predetermined spinning height relative to the respective motion arm, lowering the motion arm assemblies in the downward direction to position the pin end of the one of the plurality of tubular stands adjacent to, but spaced from, the box end of the tubular string; and landing the one of the plurality of tubular stands on the tubular string using the compensator pistons.

17. The method according to claim 12, the method further comprising the step of:

using the motion arm assemblies to land the one of the plurality of tubular stands on the tubular string, while only part of the weight of the one of the plurality of tubular stands is transferred to the tubular string.

18. The method according to claim 17, further comprising the steps of:

prior to landing the one of the plurality of tubular stands on the tubular string:

actuating the compensator pistons by increasing the pressure in the compensator pistons to provide the predetermined tubular stand weight support pressure, the tubular stand weight support pressure being less than 100% of the tubular stand weight; and lowering the motion arm assemblies in the downward direction to land the one of the plurality of tubular stands on the tubular string.

19. The method according to claim 18, further comprising the steps of:

after the one of the plurality of tubular stands has landed on the tubular string, further lowering the motion arm assemblies while keeping the tubular stand weight support pressure constant, and thus keeping the weight transferred onto the tubular string constant, thus moving the grippers upwards relative to the respective motion arm; and when the grippers have obtained a predetermined spinning height relative to the respective motion arm, stopping the movement of the motion arm assemblies in the downward direction.

* * * * *